United States Patent [19]

Muhr et al.

[11] 4,381,169

[45] Apr. 26, 1983

[54] MANIPULATOR

[75] Inventors: Richard Muhr, Attendorn; Karl Steinhoff, Lennenstadt, both of Fed. Rep. of Germany

[73] Assignee: Muhr und Bender, Attendorn, Fed. Rep. of Germany

[21] Appl. No.: 208,499

[22] Filed: Nov. 14, 1980

[30] Foreign Application Priority Data

Nov. 17, 1979 [DE] Fed. Rep. of Germany ..... 2946469

[51] Int. Cl.[3] ..... B25J 15/00; B66F 9/00

[52] U.S. Cl. ..... 414/753; 414/20; 414/740; 294/88; 294/116

[58] Field of Search ..... 294/88, 116; 414/14, 414/17, 20, 753, 729, 740

[56] References Cited

U.S. PATENT DOCUMENTS 3,095,983 7/1963 Hanna ..... 414/17 X
3,219,376 11/1965 Peters ..... 294/116 X
3,630,391 12/1971 Wilson ..... 294/116 X
3,945,676 3/1976 Asamoto ..... 294/88
4,211,123 7/1980 Mack ..... 294/116 X

FOREIGN PATENT DOCUMENTS 1002171 8/1965 United Kingdom ..... 294/116

*Primary Examiner*—Robert J. Spar
*Assistant Examiner*—Terrance L. Siemens
*Attorney, Agent, or Firm*—Karl F. Ross; Herbert Dubno

[57] ABSTRACT

A support carriage of a manipulator carries an outrigger arm on which is mounted a grab assembly. Upper and lower jaws pivotal on the assembly about respective superposed upper and lower parallel axes can be moved by an actuator head engaging both of these jaws from an open position in which the jaws are pivoted apart from each other to a closed position in which the jaws are pivoted together. The lower jaw is moved at first into the closed position and locked therein before the upper jaw is moved all the way down into the closed position.

10 Claims, 3 Drawing Figures

MANIPULATOR

FIELD OF THE INVENTION

The present invention relates to a manipulator. More particularly this invention concerns a manipulator used to grab the end of a profile-steel workpiece and position this workpiece with respect to drilling, cutting, shearing, or other equipment.

BACKGROUND OF THE INVENTION

A profile-steel beam is normally supported on rollers as it is passed through various cutting, boring, and shearing machines. To insure perfect positioning of the workpiece with respect to these machines it is normally gripped tightly at one end by a manipulator which pushes and holds the workpiece in the appropriate positions with a high degree of accuracy.

To achieve this the manipulator must very securely grab the workpiece. The manipulator normally is carried on a carriage displaceable in the desired direction. The manipulator itself has upper and lower jaws. The lower jaw is fixed and has an upper surface lying normally just below the level at which the workpiece is supported on the roller table. The upper jaw can be pivoted between an open position relatively far from the lower jaw and a closed position relatively close to it. Normally the jaws are formed so that they are complementary to the profile of the workpiece being gripped, whether it be I-section, L-section, T-section, flat, V-shaped, or U-shaped.

The disadvantage with this arrangement is that occasionally the end to be gripped is bent slightly downwardly or mushroomed slightly from previously operations. In such a system as the carriage carrying the manipulator is advanced to grip the end of the workpiece the lower jaw cannot slide under the workpiece. The machine operator must therefore lift the workpiece slightly to place it on the lower jaw before the workpiece can be gripped by the manipulator. Such an operation obviously slows down the production.

OBJECTS OF THE INVENTION

It is therefore an object of the present invention to provide an improved manipulator.

Another object is to provide such a manipulator which overcomes the above-given disadvantage of the known manipulators.

SUMMARY OF THE INVENTION

These objects are attained according to the instant invention in a manipulator of the above-described general type, but wherein both the upper and lower jaws are pivoted about respective superposed upper and lower parallel axes on the body of the manipulator. The actuator means is engageable with both of these jaws for displacing same between an open position in which the jaws are pivoted apart from each other and a closed position in which the jaws are pivoted together. Thus it is possible to grab the end of a workpiece even when this end has been somewhat mushroomed or bent downwardly, as the lower jaw in its open position will lie well below the lowermost edge of such a workpiece. This therefore eliminates the manual operation of fitting such a workpiece into the manipulator.

According to further features of this invention interengaging formations on the jaws and actuator head displace the lower jaw into the closed position before displacing the upper jaw into the closed position. More particularly the lower jaw will be moved up into and locked in its closed position before the upper jaw has moved down into its closed position. This therefore insures that the workpiece will be held at the appropriate level, with the closed position of the lower jaw corresponding to the normal position of the fixed lower jaw in a prior-art device. As the actuator head displaces the two jaws together, therefore, they will assume after part of the actuation stroke the same position that the prior-art manipulators are always in. This insures proper holding of the workpiece at the desired level while making it possible to grip a workpiece that is lying for some reason or other partly under this level.

According to further features of this invention, this last-mentioned effect is achieved by having interengageable flat surfaces on the lower jaw and the actuator head that engage one another flatly in the open and closed positions. These surfaces include first planar surfaces on the head and the lower jaw that engage each other flatly in the open position and that lie in this open position in a plane not including the lower axis, and second flat surfaces that engage each other flatly in the second position and that lie in the closed position in a plane extending between the upper and lower axes. Thus in the closed position the lower jaw will be held anvil-fashion in position. The upper jaw is displaced downwardly by an arcuately curved surface on the head that displaces it smoothly toward the lower jaw at a velocity that decreases as the closed position is approached.

Normally the manipulator is carried on an outrigger arm extending in the displacement direction from the positioning carriage. In accordance with the instant invention the actuator head is provided at one end of a rod which extends along the outrigger arm and its other end is connected at the positioning carriage to an appropriate motor such as a hydraulic cylinder. With the above-described interengaging surfaces that close the jaws the linear position of this rod will therefore be directly related to the positions of the jaws.

According to another feature of this invention an end switch is provided connected operatively to the actuator head, normally being connected at the carriage end of the actuator rod. This switch generates an output, either by opening or closing a circuit, whenever the jaws, on moving from the open to the closed position, pass a predetermined intermediate position corresponding to a very close positioning of the outer ends of the jaws. This output first generates an alarm indicating that there is no workpiece between the jaws, and second stops further motion of the jaws toward each other. Such a safety device indicates to the operator of the machine when the workpiece has not been properly grasped, and prevents the actuator from closing the jaws so tightly together that they damage each other.

SPECIFIC DESCRIPTION

Figure 1:
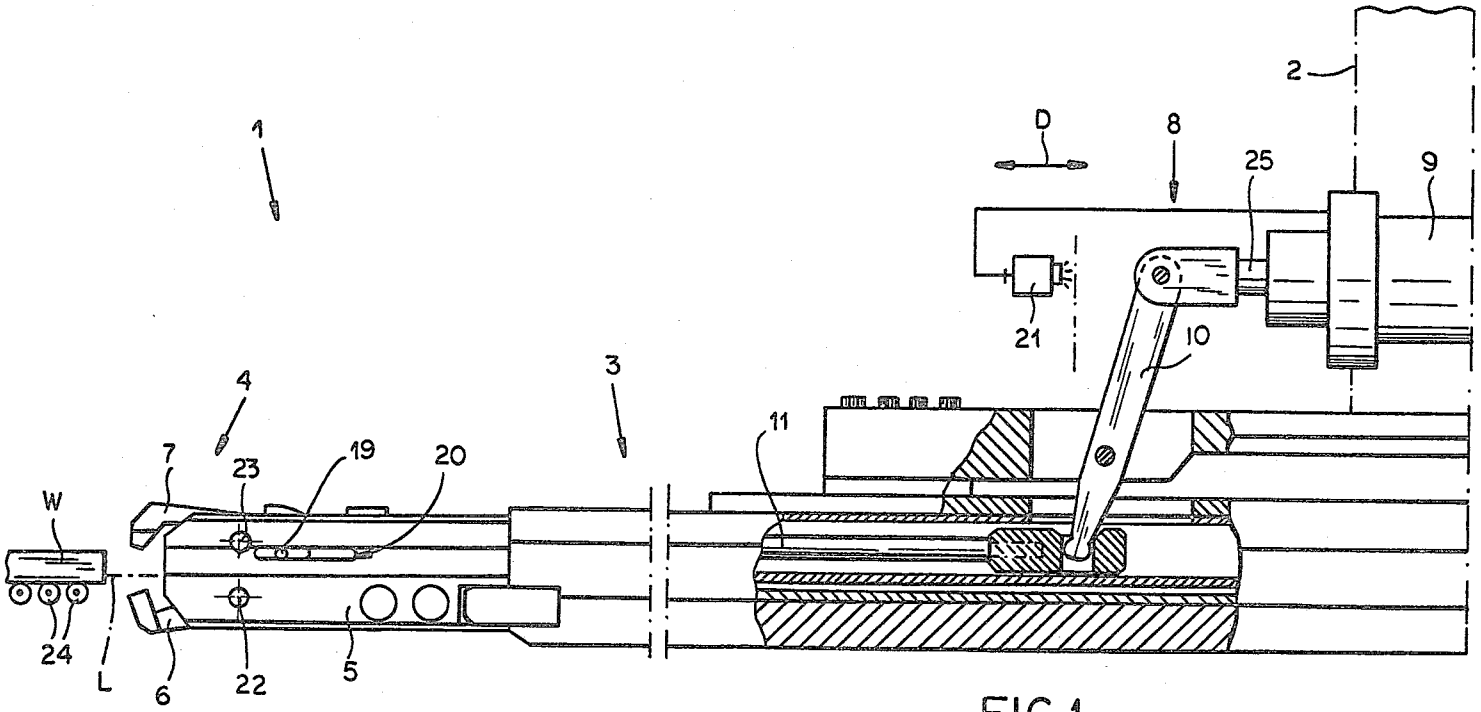
FIG. 1 is a side view of the manipulator according to the instant invention.

As seen in FIG. 1 a manipulator 1 according to the instant invention is carried via an arm 3 on a carriage 2 displaceable in a direction D parallel to the arm 3 toward and away from the end of a workpiece W supported on rollers 24. This arm 3 carries at its upper end a gripper or grab 4 having a body 5 carrying a lower jaw 6 and an upper jaw 7. An actuator 8 constituted as a hydraulic cylinder 9 is carried on the carriage 2 and has a piston rod 25 connected to one end of a pivoted link 10 whose other end is connected to an end of an actuator rod 11 extending through the arm 3.

Figure 2:
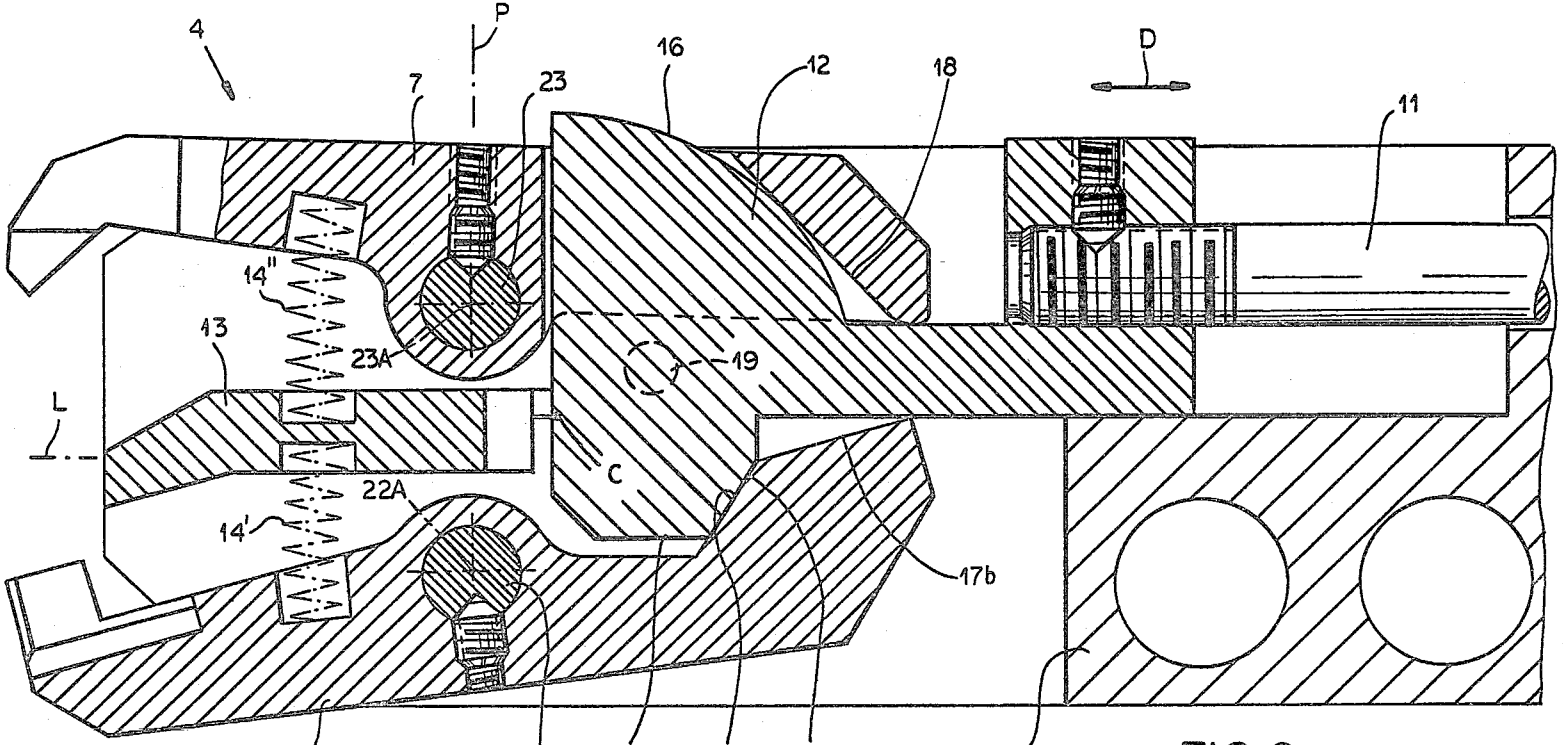
FIGS. 2 and 3 are side views in the open and closed positions, respectively, of the grab head of the manipulator according to this invention.
Figure 3:
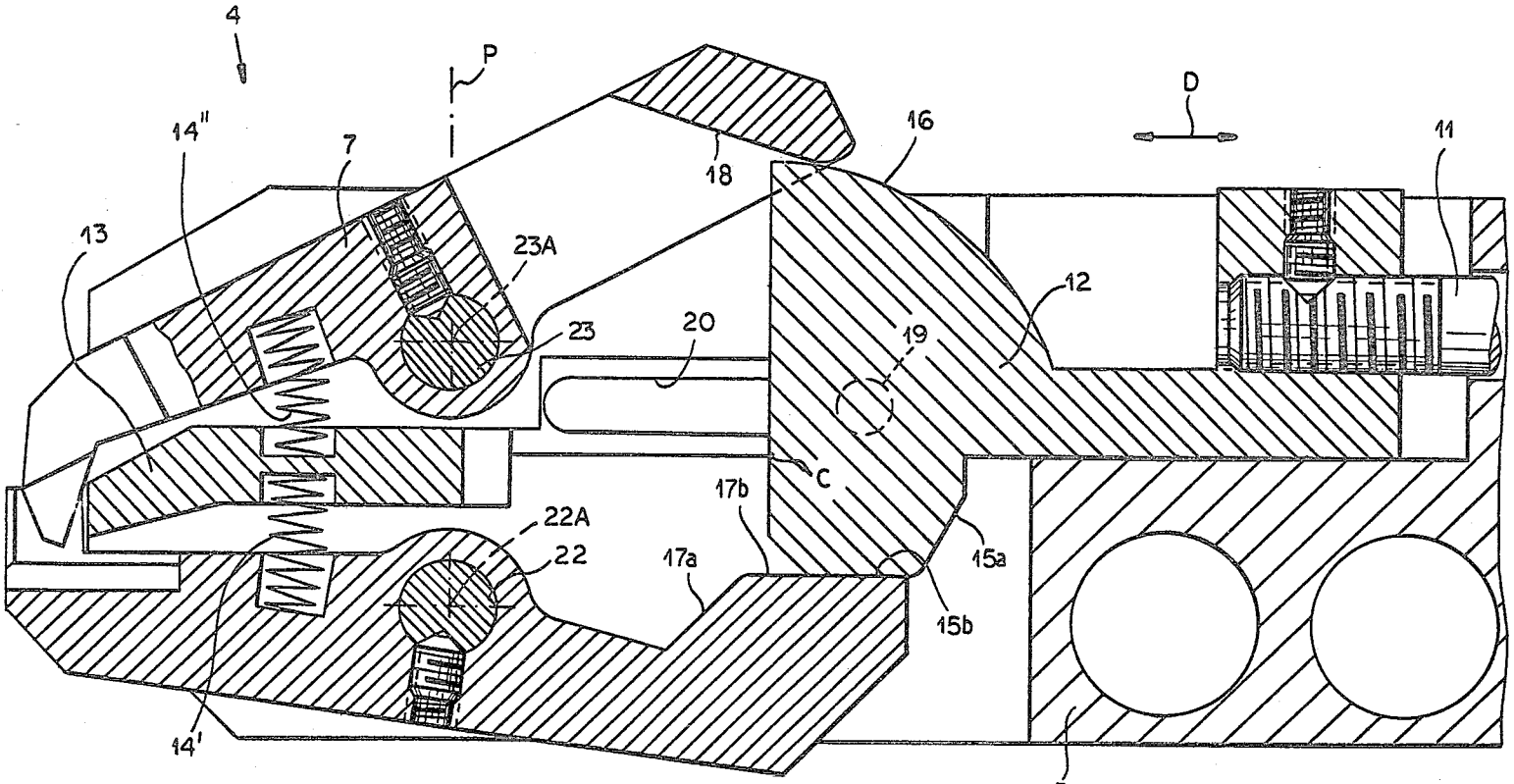

As best seen in FIGS. 2 and 3 this actuator rod 11 is provided on its outer end with a head 12 provided with laterally projecting pins received in slots 20 of the body 5 of the machine so that this head 12 can only move in the direction D.

The jaws 6 and 7 are carried on respective pivot pins 22 and 23 defining axes 22A and 23A that are parallel to each other and lie one above one another in a vertical plane P. The body 5 has a web 13 between the two jaws 6 and 7 and springs 14' and 14" are braced between this web 13 and the lower and upper jaws 6 and 7, respectively. Thus these springs 14' and 14" urge these jaws 6 and 7 pivotally about their axes 22A and 23A into the open position seen in FIG. 2.

The lower portion of the head 12 is formed with flat surfaces 15*a* and 15*b* engageable with flat surfaces 17*a* and 17*b* of the inner end of the lower jaw 6. In the open position the two surfaces 15*a* and 17*a* flatly engage one another, extending at an angle of approximately 30° to the plane P. As it is displaced backward these relatively steep surfaces 15*a* and 17*a* therefore rapidly cam the lower jaw 6 pivotally about its axis 22*a* upwardly until the flat surface 15*b* lies against the flat surface 17*b*. These surfaces 15*b* and 17*b* lie in the open position shown in FIG. 3 perpendicular to the plane P, and in a plane extending between the axes 22A and 23A. In this position a downward force exerted on the outer end of the jaw 6 will be converted into an upwardly effective force transmitted in surface contact through the surfaces 15*b* and 17*b* to the pins 19 received in the groove 20. Thus in this position the lower jaw 6 will be held extremely solidly.

The upper portion of the head 12 is formed with a cylindrically arcuate surface 16 having a center of curvature C lying horizontally approximately midway between the two axes 22A and 23A. This surface 16 engages a flat surface 18 of the upper jaw 7, which surface 18 lies at an angle of approximately 45° to the plane P in the open position of FIG. 2. Thus as the head 12 moves back the upper jaw 7 will be pivotally cammed with ever-decreasing speed down toward the lower jaw 6. The lower jar 6 will, however, be moved into its fully closed position well before the upper jaw 7 has moved into its closed position.

A switch 21 provided on the carriage 2 can coact with the link 10 and end of the piston rod 25 to generate an alarm and shutoff of hydraulic fluid to the cylinder 9 when the jaws 6 and 7 have moved, when being displaced from the open to the closed position, past an intermediate position slightly wider open than the position shown in FIG. 3. This switch 21 therefore will indicate to the operator that no workpiece has been gripped between the jaws 6 and 7, and will also shut down the device to prevent excessive travel of the head 12.

With the system according to the instant invention, therefore, when a workpiece to be picked up lies below the level indicated at L in FIGS. 1 and 2 it will not simply be butted out of the way by the lower jaw 6. Instead the carriage 2 moves in the direction D with the jaws 6 and 7 open toward the workpiece W the lower jaw 6 will easily be moved under it. Then on operation of the cylinder 9 the lower jaw will swing up into position, lifting the workpiece W so that its lowermost surface lies at the level L if necessary. The upper jaw 7 will meanwhile be traveling down to grip the upper surface of the workpiece and hold it tightly for machining operation.

We claim:

1. A manipulator for heavy objects, said manipulator comprising:

a support carriage;

a manipulator body fixed on and displaceable with said carriage;

an upper jaw and a lower jaw pivotal on said body about respective superposed upper and lower parallel axes, said upper jaw being formed with a downwardly directed actuation face and said lower jaw being formed with a generally upwardly directed and flat actuation face; and actuator means including an actuator head having an arcuate and generally upwardly directed operating face engageable with said downwardly directed face of said upper jaw and a generally downwardly directed and flat actuation face flatly engageable with said upwardly directed face of said lower jaw for displacing same between an open position in which said jaws are pivoted apart from each other and a closed position in which said jaws are pivoted together, the faces being so spaced and oriented that on displacement from said open to said closed position said lower jaw is pivoted up into said closed position before said upper jaw is pivoted down into said closed position.

2. The manipulator defined in claim 1 wherein said downwardly directed face of said head and said upwardly directed face of said lower jaw include respective first surfaces on said head and lower jaw that engage each other flatly in said open position and that lie in said open position in a plane not including said lower axis and respective second flat surfaces that engage each other flatly in said closed position and that lie in said closed position in a plane extending between said axes.

3. The manipulator defined in claim 2 wherein said plane of said second surfaces in said closed position is substantially perpendicular to the plane of said axes.

4. The manipulator defined in claim 1 wherein said head is displaceable perpendicular to the plane of said axes for displacement of said jaws between the open and closed positions.

5. The manipulator defined in claim 4, further comprising guide means for permitting said head only to move perpendicular to the plane of said axes, said guide means including interengaging formations on said body and head.

6. The manipulator defined in claim 1, further comprising an end switch connected to and operated by said actuator means for generating an output when said jaws, on displacement from said open to said closed position, move past a predetermined intermediate position.

7. The manipulator defined in claim 1 wherein each of said jaws has a front end projecting forwardly from said body and a rear end engaging said head, said axes lying between said ends.

8. The manipulator defined in claim 1 wherein said carriage is movable perpendicular to the plane of said axes.

9. The manipulator defined in claim 1, further comprising spring means engaging said jaws for urging same into said open position.

10. The manipulator defined in claim 1 wherein said upwardly directed face of said actuator head is circularly arcuate.

* * * * *